US008725012B2

(12) United States Patent
Murayama

(10) Patent No.: US 8,725,012 B2
(45) Date of Patent: May 13, 2014

(54) IMAGE FORMING APPARATUS AND A METHOD FOR DETERMINING A CONDITION OF TONER

(75) Inventor: Kentaro Murayama, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 37 days.

(21) Appl. No.: 13/413,297

(22) Filed: Mar. 6, 2012

(65) Prior Publication Data

US 2012/0251135 A1 Oct. 4, 2012

(30) Foreign Application Priority Data

Mar. 28, 2011 (JP) ..... 2011-069097

(51) Int. Cl.
*G03G 15/08* (2006.01)
*G03G 15/00* (2006.01)

(52) U.S. Cl.
USPC ..... 399/29; 399/27; 399/49

(58) Field of Classification Search
USPC ..... 399/27, 29, 30, 49
See application file for complete search history.

(56) References Cited

U.S. PATENT DOCUMENTS

| | | | | |
|---|---|---|---|---|
| 5,950,043 | A | 9/1999 | Fujita et al. | |
| 6,795,668 | B1 | 9/2004 | Nishiwaki | |
| 7,305,195 | B2 * | 12/2007 | Ishibashi | 399/49 |
| 7,346,286 | B2 * | 3/2008 | Matsumoto et al. | 399/29 |
| 7,865,095 | B2 * | 1/2011 | Kakutani | 399/49 |
| 2005/0185973 | A1 | 8/2005 | Hama et al. | |
| 2005/0249515 | A1 | 11/2005 | Furukawa et al. | |

FOREIGN PATENT DOCUMENTS

| | | |
|---|---|---|
| JP | 8-166718 | 6/1996 |
| JP | 10-020578 | 1/1998 |
| JP | 10-123820 | 5/1998 |
| JP | 11-184277 | 7/1999 |
| JP | 11-265132 | 9/1999 |
| JP | 2004-045458 | 2/2004 |
| JP | 2004-157179 | 6/2004 |
| JP | 2004-354666 | 12/2004 |
| JP | 2006-106069 | 4/2006 |
| JP | 2007-171541 A | 7/2007 |
| JP | 2007-193189 | 8/2007 |
| JP | 2007-206344 A | 8/2007 |

OTHER PUBLICATIONS

Notification of Reasons for Rejection issued in corresponding Japanese Patent Application No. 2011-069097 mailed Mar. 19, 2013.

* cited by examiner

*Primary Examiner* — Sandra Brase
(74) *Attorney, Agent, or Firm* — Banner & Witcoff, Ltd.

(57) ABSTRACT

In an image forming apparatus, a control device obtains an amount of toner in a first area and an amount of toner in a second area. The first area is defined on a conveying member that is in contact with a photosensitive member. The transfer of toner is assured in the first area of the conveying member, but is not assured in the second area. The control device determines a toner condition based on a difference in the amount of toner between the first area and the second area. When the difference in the amount of toner is larger, the control device determines that the toner is in a deteriorated condition. When the difference in the amount of toner is smaller, the control device determines that the toner is not in the deteriorated condition.

20 Claims, 10 Drawing Sheets

IMAGE FORMING APPARATUS AND A METHOD FOR DETERMINING A CONDITION OF TONER

CROSS-REFERENCE TO RELATED APPLICATION

This application claims priority from Japanese Patent Application No. 2011-069097, filed on Mar. 28, 2011, which is incorporated herein by reference.

BACKGROUND

1. Technical Field

One or more aspects of the invention relate to image forming apparatus that form an image using toner by an electrophotographic method, and more specifically, image forming apparatus that determine toner condition based on toner transfer condition.

2. Description of Related Art

In a known electrophotographic image forming apparatus, insufficiently-charged toner may appear due to toner deterioration. The insufficiently-charged toner may move from a photosensitive member to a transfer member, e.g., a conveyor belt, in an unintended area, and thus make one or both of the transfer member and a sheet dirty. To prevent this problem, a known image forming apparatus determines toner condition. When the image forming apparatus determines that toner is in the deteriorated condition, the image forming apparatus provides notification that a developing unit, which stores the deteriorated toner, needs to be replaced.

In a known technique for determining the toner condition, an image forming apparatus includes a sensor that detects a surface condition of photosensitive belt. The image forming apparatus determines the toner condition based on an amount of reflected light from the intermediate transfer belt.

SUMMARY

Nevertheless, problems may arise in the known image forming apparatus. When the image forming apparatus determines the toner condition based on the surface condition of the belt, the image forming apparatus may misidentify damage or dirt, which is matter other than toner, on the surface of the belt, as toner. Therefore, accuracy of the toner condition determination may be susceptible to improvement.

One or more aspects of the invention were made to solve the problem that has arisen in the known image forming apparatus. An embodiment provides for an image forming apparatus that may determine toner condition with higher accuracy.

An image forming apparatus disclosed herein may comprise a photosensitive member, a developing device, a conveying member, a detector, and a control device. The developing device may be configured to store toner and form a toner image with the toner on the photosensitive member. The conveying member may be configured to convey the toner transferred from the photosensitive member, and include a first area, on which the toner is transferred, and a second area, on which the toner is not transferred. The detector may be configured to detect one or more properties of the toner and, the control device may be configured to measure an amount of toner present on the conveying member. The control device may be configured to determine whether the toner is in the deteriorated condition based on a difference in the amount of toner between the first area and the second area.

Other aspects, features, and advantages will be apparent to persons of ordinary skill in the art from the following detailed description and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS

Embodiments in which an image forming apparatus according to one or more aspects of the invention are implemented now are described in detail with reference to the accompanying drawings, like numerals being used for like corresponding parts in the various drawings. In one or more embodiments, one or more aspects of the invention may be applied to a multifunction peripheral device ("MFP") having a color printing function.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

Figure 1:
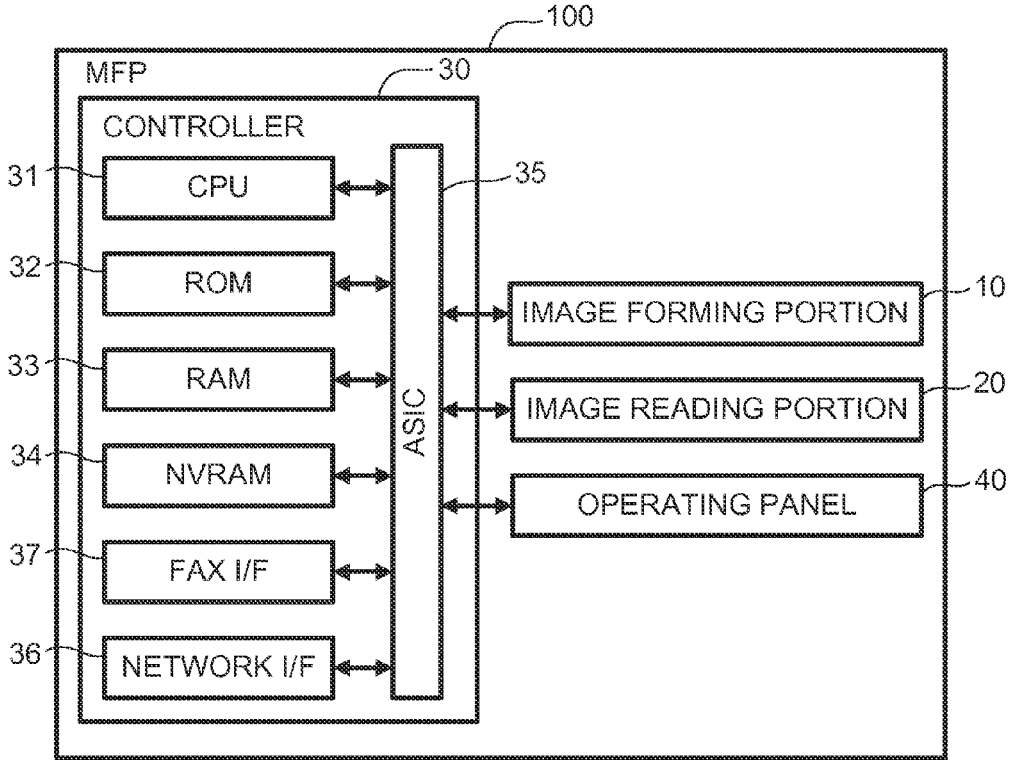
FIG. 1 is a block diagram depicting an electric configuration of a multifunction peripheral device in an embodiment according to one or more aspects of the invention.

As depicted in FIG. 1, an MFP 100 may comprise a controller 30 (an example of a determining unit and an identifying unit) that may comprise a central processing unit ("CPU") 31, a read-only memory ("ROM") 32, a random-access memory ("RAM") 33, a nonvolatile random-access memory ("NVRAM") 34, an application-specific integrated circuit ("ASIC") 35, a network interface ("I/F") 36, and a facsimile interface ("FAX I/F") 37. Controller 30 may be electrically connected with an image forming portion 10, an image reading portion 20, and an operating panel 40. Image forming portion 10 may be configured to form an image onto a sheet S. Image reading portion 20 may be configured to read an image from a document. Operating panel 40 may be configured to display operating statuses and to accept a user's input operation.

CPU 31 may serve as a control center and may be configured to perform computations for accomplishing various functions, e.g., an image reading function, an image forming function, a facsimile data transmitting/receiving function, and a toner-condition determining function (described below), which may be performed in MFP 100. ROM 32 may store various control programs and settings for controlling MFP 100 as well as certain initial values. RAM 33 may be used as a workspace for temporarily storing the control programs read from ROM 32 or as a storage area for temporarily storing image data. NVRAM 34 may be used as a storage area for storing various settings and image data.

CPU 31 may control functions of each component or each portion of MFP 100 (e.g., a timing at which an exposure device, that constitutes image forming portion 10, irradiates light, and a timing at which drives motors for rollers constituting a sheet-conveying path are driven and stopped) via ASIC 35. Further, CPU 31 may store processing results in RAM 33 or NVRAM 34, in accordance with the control programs read from ROM 32 and signals sent from a sensor 61.

Network interface 36 may be connected with a network that may allow MFP 100 to connect with another information processing device. FAX interface 37 may be connected with a telephone line that may allow MFP 100 to connect with a facsimile machine at another end of the telephone line. MFP 100 may perform data communications with external devices via network interface 36 or FAX interface 37.

An internal structure of image forming portion 10 of MFP 100 now is described with reference to FIG. 2. Image forming portion 10 may comprise a process portion 50, a fixing unit 8, a sheet feed tray 91, and a sheet discharge tray 92. Process portion 50 may form a toner image by an electrophotographic method and may transfer the toner image onto a sheet S. Fixing unit 8 may fix the transferred toner onto the sheet S. Sheet feet tray 91 may hold therein sheets S to which images have not been transferred. Sheet discharge tray 92 may hold sheets S on which images have been transferred. An image reading portion 20 may be disposed above image forming portion 10.

Process portion 50 may comprise process units 50C, 50M, 50Y, 50K. Image forming portion 10 may comprise an exposure unit 53, a conveyor belt 7 (an example of a conveying member), and sensor 61, such as an optical sensor. Exposure unit 53 may irradiate each process unit 50C, 50M, 50Y, 50K with light. Conveyor belt 7 may convey a sheet S to a transfer position of each process unit 50C, 50M, 50Y, 50K. Sensor 61 (an example of a detector) may detect a mark formed on conveyor belt 7.

A substantially S-shaped conveying path 11 (indicated by a dot and dashed line in FIG. 2) may be provided in image forming portion 10, such that a sheet S, which may be loaded on sheet feed tray 91 at the bottom of image forming portion 10, may be guided to sheet discharge tray 92 through a sheet feed roller 71, a registration roller 72, process portion 50, fixing unit 8, and a discharge roller 76.

Process units 50C, 50M, 50Y, 50K may correspond to respective colors of cyan C, magenta M, yellow Y, and black K. Accordingly, process portion 50 may form an image in color. In process portion 50, process units 50C, 50M, 50Y, 50K may be disposed in parallel with each other. Specifically, process unit 50C may form an image with toner of cyan C, process unit 50M may form an image with toner of magenta M, process unit 50Y may form an image with toner of yellow Y, and process unit 50K may form an image with toner of black K. Process units 50C, 50M, 50Y, 50K may be separated from each other at a predetermined distance in a sheet-conveying direction and may be arranged in this order from downstream in the sheet-conveying direction. The arrangement order of process units 50C, 50M, 50Y, 50K may not be limited to the specific embodiment of the invention.

Figure 3:
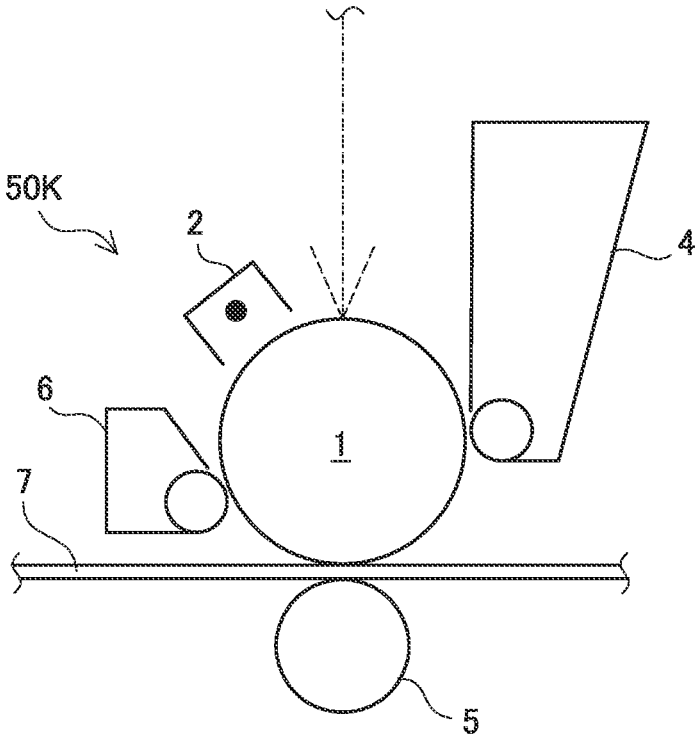
FIG. 3 is a schematic view depicting an internal structure of a process unit of the multifunction peripheral device of FIG. 1 in the embodiment according to one or more aspects of the invention.

A structure of process unit 50K now is described with reference to FIG. 3. Process unit 50K may comprise a drum-shaped photosensitive member 1, a charger 2, a developing unit 4, a transfer unit 5, and a cleaner 6. Charger 2 may uniformly charge a surface of photosensitive member 1. Developing unit 4 may develop an electrostatic latent image by using toner. Transfer unit 5 may transfer a toner image formed on photosensitive member 1 onto a sheet S. Cleaner 6 may electrically catch toner remaining on photosensitive member 1 after transfer unit 5 transfers a toner image onto the sheet S from the surface of photosensitive member 1. Photosensitive member 1 and transfer unit 5 may be in contact with conveyor belt 7 and may be disposed on opposite sides of conveyor belt 7 while sandwiching conveyor belt 7 therebetween. Process units 50C, 50M, 50Y may have the same structure as process unit 50K described above.

In each process unit 50C, 50M, 50Y, 50K, the surface of photosensitive member 1 may be charged uniformly by charger 2. Then, the surface of photosensitive member 1 then may be exposed to light from exposure unit 53. In this manner, an electrostatic latent image of an image to be formed on a sheet S may be formed on the surface of photosensitive member 1. After that, developing unit 4 may supply toner to photosensitive member 1. Thus, the electrostatic latent image formed on photosensitive member 1 may become a toner image.

In image forming portion 10, sheet feed roller 71 may pick up a sheet S loaded in sheet feed tray 91 and may convey the sheet S to registration roller 72. Registration roller 72 may convey the sheet S onto conveyor belt 7. Then, transfer unit 5 may transfer a toner image formed in process portion 50 onto the sheet S. In a color printing process, each process unit 50C, 50M, 50Y, 50K may form a toner image, and the formed toner images may overlap on the sheet S when transferred to form the color image. In a monochrome printing process, process unit 50K alone may form a toner image which transfer unit 5 may transfer onto the sheet S. After transfer unit 5 transfers the toner image onto the sheet S, conveyor belt 7 may convey the sheet S to fixing unit 8. Fixing unit 8 thermally may fix the color or monochrome toner image onto the sheet S. Then, the sheet S having the fixed toner image may be discharged onto sheet discharge tray 92.

Conveyor belt 7 may be an endless belt member wound around conveyor rollers 73, 74 (See FIG. 2) and may be made of resin material, e.g., polycarbonate. Conveyor roller 74 may be a drive roller that is driven by a drive motor 75. Conveyor belt 7 may rotate in a counterclockwise direction in FIG. 2 when conveyor roller 74 rotates. With this rotation, conveyor belt 7 may convey a sheet S placed on a surface thereof from registration roller 72 to fixing unit 8. Conveyor roller 73 may rotate by following the rotation of conveyor belt 7.

Sensor 61 may be disposed downstream of process units 50C, 50M, 50Y, 50K in a rotating direction of conveyor belt 7. Sensor 61 may detect marks for image adjustment, which process units 50C, 50M, 50Y, 50K may form and transfer unit 5 may transfer onto conveyor belt 7.

Figure 4:
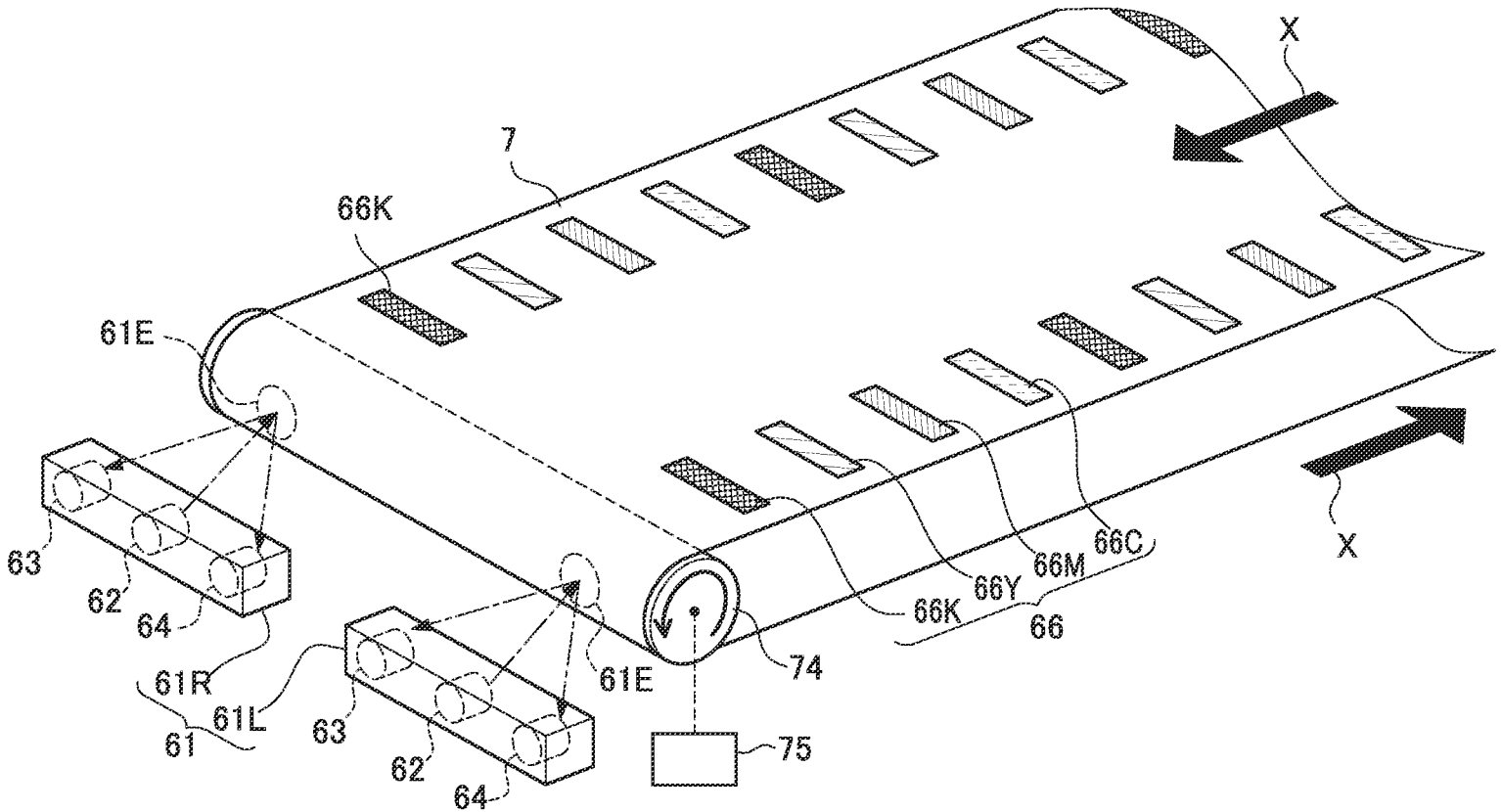
FIG. 4 depicts an illustrative arrangement of sensors and marks for positional deviation correction in the embodiment according to one or more aspects of the invention.

More specifically, as depicted in FIG. 4, sensor 61 may comprise a plurality of, e.g., two, sensors 61R, 61L arranged side by side in a width direction of conveyor belt 7. Sensor 61R may be disposed at a right side of conveyor belt 7 in the width direction, and sensor 61L may be disposed at a left side of conveyor belt 7 in the width direction. Each of sensors 61R, 61L may be a reflection type optical sensor, and each of sensors 61R, 61L may comprise a light-emitting element 62, e.g., a light-emitting diode (LED), and light receiving elements 63, 64, e.g., a phototransistor. In each sensor 61R, 61L, light-emitting element 62 may irradiate the surface of conveyor belt 7 (e.g., a measurement position 61E indicated by a dashed line in FIG. 4) with light from an oblique direction, and light receiving element 63 may receive specular reflection light from the surface of conveyor belt 7 and light receiving element 64 may receive diffuse reflection light from the surface of conveyor belt 7. Alternatively, or additionally, sensor 61 may be any other type of sensor that is able to detect toner on conveyor belt 7.

The marks for image adjustment may comprise, for example, a registration pattern 66 to be used for positional deviation detection. Registration pattern 66 may comprise a group of marks 66C, 66M, 66Y, 66K, which respective process units 50C, 50M, 50Y, 50K may form and which transfer unit 5 may transfer onto conveyor belt 7. Referring to FIG. 4, conveyor belt 7 may convey registration pattern 66 in a conveying direction indicated by an arrow X as conveyor belt 7 rotates. Sensor 61 may detect of each of marks 66C, 66M, 66Y, 66K based on a difference between an amount of received light reflected from each of marks 66C, 66M, 66Y, 66K formed on the surface of conveyor belt 7 and an amount of received light directly reflected from the surface of conveyor belt 7. MFP 100 may obtain an amount of deviation with respect to each toner color based on the detection results of marks 66C, 66M, 66Y, 66K and correct the positional deviations based on the obtained amount of deviation for each toner color.

Sensor 61 may be used for measurement of an amount of toner on conveyor belt 7. In this embodiment, controller 30 may estimate the amount of toner on conveyor belt 7 based on a difference between an amount of specular reflection light obtained from light-receiving element 63 and an amount of diffuse reflection light obtained from light-receiving element 64 (hereinafter referred to as "reflection amount difference").

Figure 5:
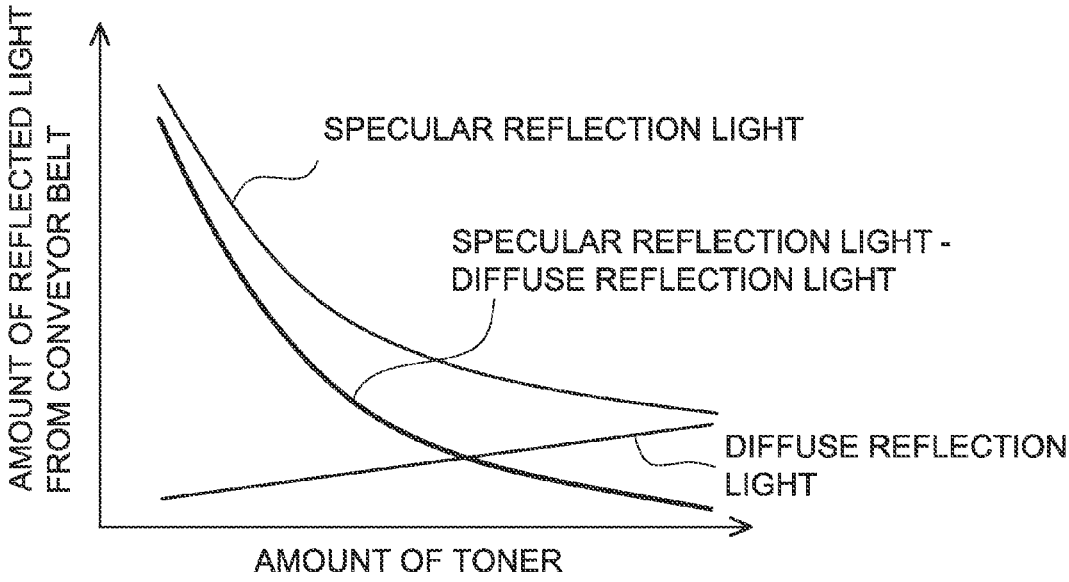
FIG. 5 is a graph representing a relationship between an amount of light reflected from a conveyor belt and an amount of toner (colors other than black) on the conveyor belt in the embodiment according to one or more aspects of the invention.

That is, light emitted onto the surface of conveyor belt 7 may be partially diffused and may be received by light-receiving element 64. Therefore, as depicted in FIG. 5, as the amount of toner on conveyor belt 7 increases, the difference between the amount of specular reflection light and the amount of diffuse reflection light may become smaller. Accordingly, the calculation of the reflection amount difference may be used for determination whether toner in deteriorated condition is present on conveyor belt 7. When the difference obtained by the calculation is smaller, controller 30 may determine that a larger amount of deteriorated toner appears on conveyor belt 7, i.e., toner, which may not be sufficiently charged, has moved onto conveyor belt 7 at a timing at which toner is not transferred actually. In this embodiment, controller 30 may determine whether toner is in the deteriorated condition based on a difference between a reflection light difference A in a portion, which held a sheet S (referred to as "conveyance portion") (an example of a second area), of conveyor belt 7, and a reflection light difference B in a portion, which did not hold a sheet S (referred to as "non-conveyance portion") (an example of a first area), of conveyor belt 7. The determination of the toner condition will be described in detail later.

Figure 2:
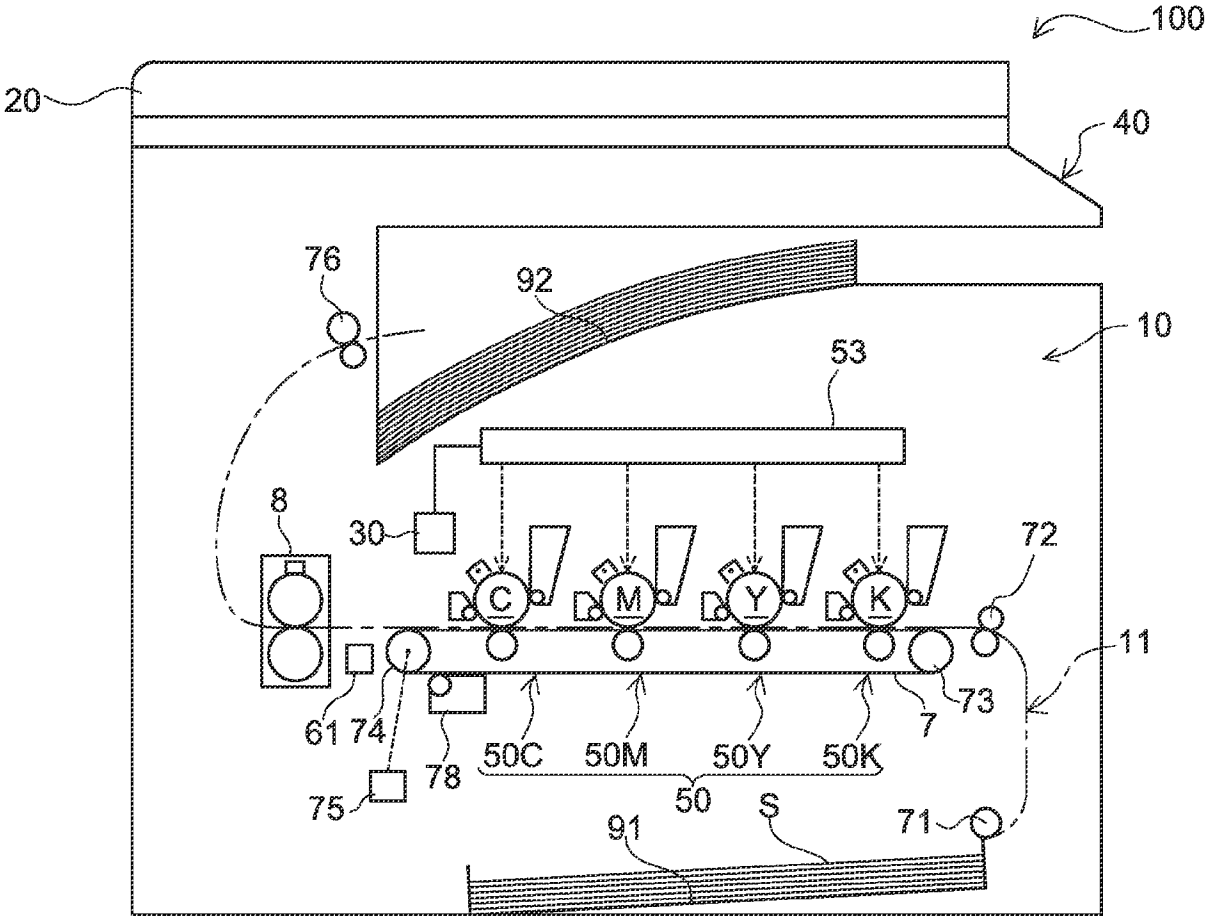
FIG. 2 is a schematic view depicting an internal structure of an image forming portion of the multifunction peripheral device of FIG. 1 in the embodiment according to one or more aspects of the invention.

In image forming portion 10, a belt cleaner 78 may be disposed in contact with conveyor belt 7 to remove toner adhering to conveyor belt 7 as depicted in FIG. 2. Belt cleaner 78 may remove marks 66C, 66M, 66Y, 66K that have passed measurement position 61E where sensor 61 may measure marks 66C, 66M, 66Y, 66K.

The toner-condition determining process for determining whether toner is in the deteriorated condition is described below with reference to FIG. 6. Controller 30 of MFP 100 may perform the toner-condition determining process upon receipt of a print job.

First, controller 30 may start printing of a received print job (step S101). As the printing operation starts, sheet feed roller 71 may pick up a sheet S loaded in sheet feed tray 91 and registration roller 72 may convey the sheet S onto conveyor belt 7. Then, transfer unit 5 may transfer a toner image onto the sheet S on conveyor belt 7 when the sheet S is passing under process portion 50.

Next, controller 30 may determine whether criteria for performance of toner-condition determination are met (step S102). The criteria for performance may be, for example, the number of sheets S printed after a previous toner-condition determination was performed or an elapsed time after the previous toner-condition determination was performed. In step S102, controller 30 may determine whether at least one of the criteria for performance is met. When at least one of the criteria for performance is met, controller 30 may determine that the necessary criteria is met. When none of the criteria for performance is met (step S102:NO), controller 30 may exit the toner-condition determining process without performing the toner-condition determination.

When at least one of the criteria for performance is met (step S102:YES), controller 30 may obtain the reflection light difference by using sensor 61 (step S103). More specifically, in step S103, controller 30 may obtain reflection light difference A in the conveyance portion of conveyor belt 7 and reflection light difference B in the nonconveyance portion of conveyor belt 7.

The reflection light difference may be obtained by reducing the amount of diffuse reflection light from the amount of specular reflection light. As depicted in FIG. 5, as the amount of toner on conveyor belt 7 increases, the difference between the amount of specular reflection light and the amount of diffuse reflection light may become smaller. Therefore, when the reflection light difference obtained by the calculation is smaller, a larger amount of toner may be present on conveyor belt 7.

Sensor 61 may not be required to measure an entire area of the conveyance portion of conveyor belt 7 to obtain reflection amount difference A, but may be required to measure a partial area of the conveyance portion of conveyor belt 7, e.g., a certain area bordering on the nonconveyance portion. Similar to this, sensor 61 may not also be required to measure an entire area of the nonconveyance portion of conveyor belt 7 to obtain reflection amount difference B, but may be required to measure a partial area of the nonconveyance portion of conveyor belt 7, e.g., a certain area bordering on the conveyance portion.

Controller 30 may determine whether a difference between reflection amount differences A and B (A–B) (which may be obtained by reducing reflection amount difference B from reflection amount difference A) obtained in sensor 61R and a difference between reflection amount differences A and B (A–B) match with each other (step S104). Here, controller 30 may determine whether the differences obtained in sensors 61R and 61L are approximately the same but not exactly the same. The surface of conveyor belt 7 may not tend to be damaged at several locations along the belt-width direction. However, conveyor belt 7 may catch deteriorated toner on its entire surface along the belt-width direction by transfer. Therefore, when controller 30 determines that the differences obtained in sensors 61R and 61L do not match with each other (step S104:NO) by comparing the difference between reflection amount differences A and B (A–B) in sensor 61R and the difference between reflection amount differences A and B (A–B) in sensor 61L, controller 30 may determine that the surface of conveyor belt 7 is damaged. Thus, the routine may move to S103 and controller 30 may re-obtain the reflection light difference.

When the differences obtained in sensors 61R and 61L match with each other (step S104:YES), controller 30 may determine whether the difference between reflection amount differences A and B (A–B) is greater than a first threshold value Th1 (step S105). As the difference between reflection amount differences A and B (A–B) increases, the toner deteriorated condition may be more severe.

That is, when the conveyance portion of conveyor belt 7 is passing under each process unit 50C, 50M, 50Y, 50K, of process portion 50, a sheet S is present between photosensitive member 1 and conveyor belt 7. Therefore, deteriorated toner may be transferred onto the sheet S. When the nonconveyance portion of conveyor belt 7 is passing under each process unit 50C, 50M, 50Y, 50K of process portion 50, a sheet S is absent between photosensitive member 1 and conveyor belt 7. Therefore, if deteriorated toner is present on photosensitive member 1, the nonconveyance portion of conveyor belt 7 may catch the deteriorated toner by application of transfer bias. As a result, reflection amount difference B may become smaller and the difference between reflection amount differences A and B (A–B) may become larger. When deteriorated toner is absent on photosensitive member 1, reflection amount difference B may hardly change, so that the difference between reflection amount differences A and B (A–B) may be smaller. As described above, controller 30 may determine the toner condition based on the difference between reflection amount differences A and B (A–B).

Figure 7:
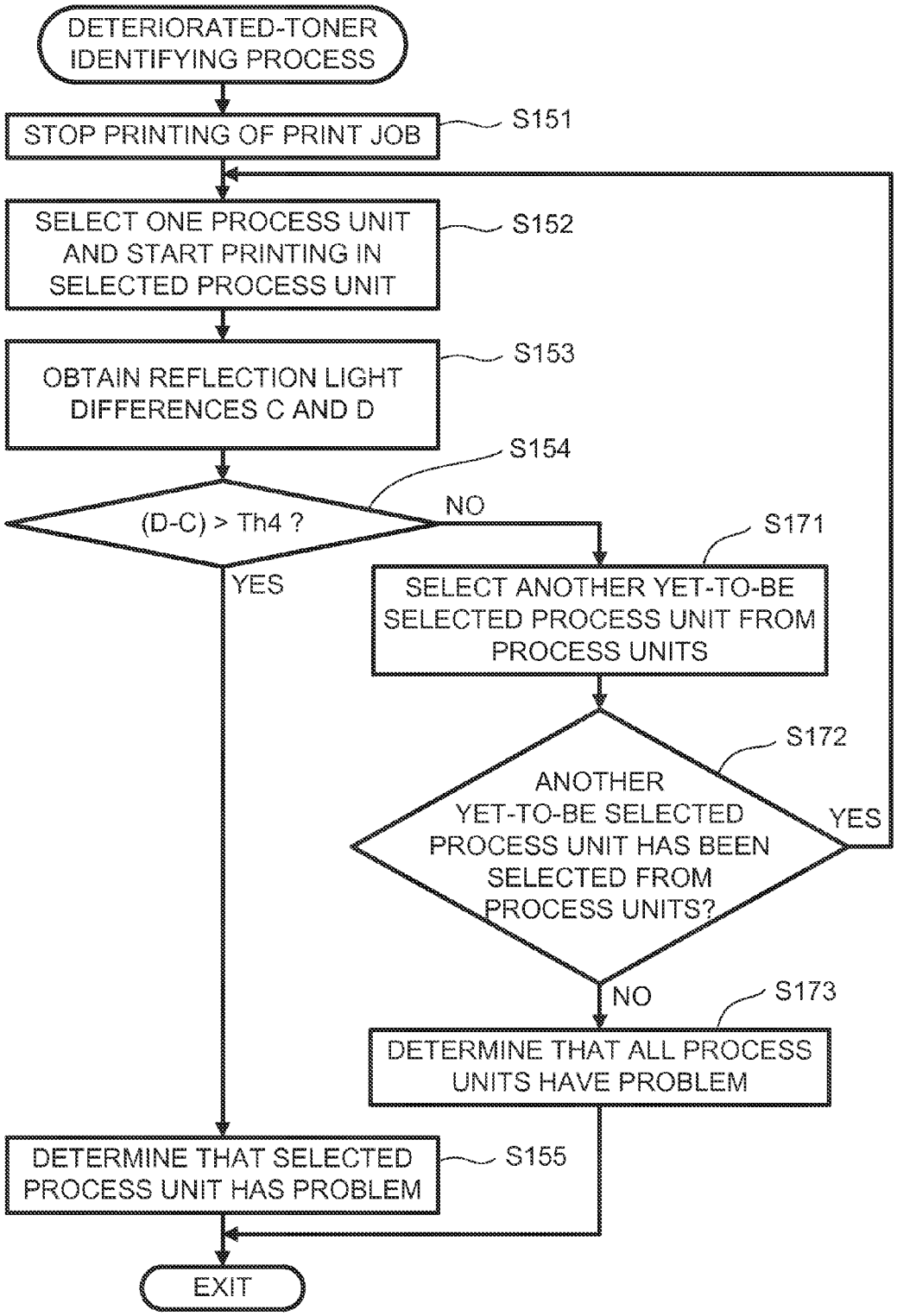
FIG. 7 is a flowchart depicting a deteriorated-toner identifying process in the embodiment according to one or more aspects of the invention.

When the difference between reflection amount differences A and B (A–B) is greater than the first threshold value Th1 (step S105:YES), controller 30 may perform a deteriorated-toner identifying process for identifying a color of toner that is in the deteriorated condition (step S106). The deteriorated-toner identifying process of step S106 is now described below with reference to FIG. 7.

First, controller 30 may stop the printing of the print job (step S151). That is, controller 30 may temporarily stop the current printing in all of process units 50C, 50M, 50Y, 50K. Then, controller 30 may select one of process units 50C, 50M, 50Y, 50K and may start printing in the selected one of process units 50C, 50M, 50Y, 50K (step S152).

In step S152, in the selected one of process units 50C, 50M, 50Y, 50K, a charging bias, a developing bias, and a transfer bias may be all "on" without a sheet S held on conveyor belt 7. In the rest of process units 50C, 50M, 50Y, 50K, a charging bias may be "on" and a developing bias and a transfer bias may be "off" without a sheet S held on conveyor belt 7. MPF 100 may comprise a mechanism configured to separate one or both of developing unit 4 and transfer unit 5 from photosensitive member 1. If one or both of developing unit 4 and transfer unit 5 are held distance from photosensitive member 1 during the application of one or more of the charging bias, the developing bias, and the transfer bias, the application of the bias may not influence the transfer of toner. Therefore, this condition may be determined that one or more of the charting bias, the developing bias, and the transfer bias is "off". Controller 30 may select one process unit from process units 50C, 50M, 50Y, 50K in order of frequency of use based on a number of rotations of a developing roller, i.e., a process unit that may have more possibility of storing deteriorated toner, with higher priority.

Then, controller 30 may obtain a reflection light difference C from an area, which passed under the selected process unit (hereinafter, referred to as a check area) (an example of the first area), of conveyor belt 7 by using sensor 61 while the selected process unit was in operation, and may also obtain a reflection light difference D from an area, which passed under all of process units 50C, 50M, 50Y, 50K while process units 50C, 50M, 50Y, 50K were not in operation (step S153). Each of reflection amount differences C and D may also be obtained by reducing the diffuse reflection light from the specular reflection light. Because the check area passed under the selected process unit while the selected process unit was in operation, the check area may tend to catch deteriorated toner if the deteriorated toner had been present on photosensitive member 1.

Next, controller 30 may determine whether a difference between reflection amount differences D and C (D–C) (which is obtained by reducing reflection amount difference C from reflection amount difference D) is greater than a fourth threshold value Th4 (step S154). Reflection amount difference D may be a reflection amount difference in an area that may not catch toner by transfer. Therefore, reflection amount difference A obtained in step S103 may be used as reflection amount difference D.

When the difference between reflection amount differences D and C (D–C) is greater than fourth threshold value Th4 (step S154:YES), controller 30 may determine that toner is in the deteriorated condition in the selected process unit. Accordingly, controller 30 may determine that the selected process unit has a problem (step S155) and exist the deteriorated-toner identifying process.

When the difference between reflection amount differences D and C (D–C) is smaller than or equal to fourth threshold value Th4 (step S154:NO), controller 30 may determine that toner is not in the deteriorated condition in the selected process unit. Then, controller 30 may select another yet-to-be selected process unit from process units 50C, 50M, 50Y, 50K (step S171).

Then, controller 30 may determine whether another yet-to-be selected process unit has been selected from process units 50C, 50M, 50Y, 50K (step S172). When another yet-to-be selected process unit has been selected (step S172:YES), the routine may move to step S152 and controller 30 may perform the toner condition determination. When none of process units 50C, 50M, 50Y, 50K has been selected, i.e., when the toner condition determination has already been performed on all of process units 50C, 50M, 50Y, 50K (step S172:NO), controller 30 may not identify the process unit that accommodates deteriorated toner. Therefore, controller 30 may determine that all of process units 50C, 50M, 50Y, 50K have a problem (step S173) and exit the deteriorated-toner identifying process.

Figure 6:
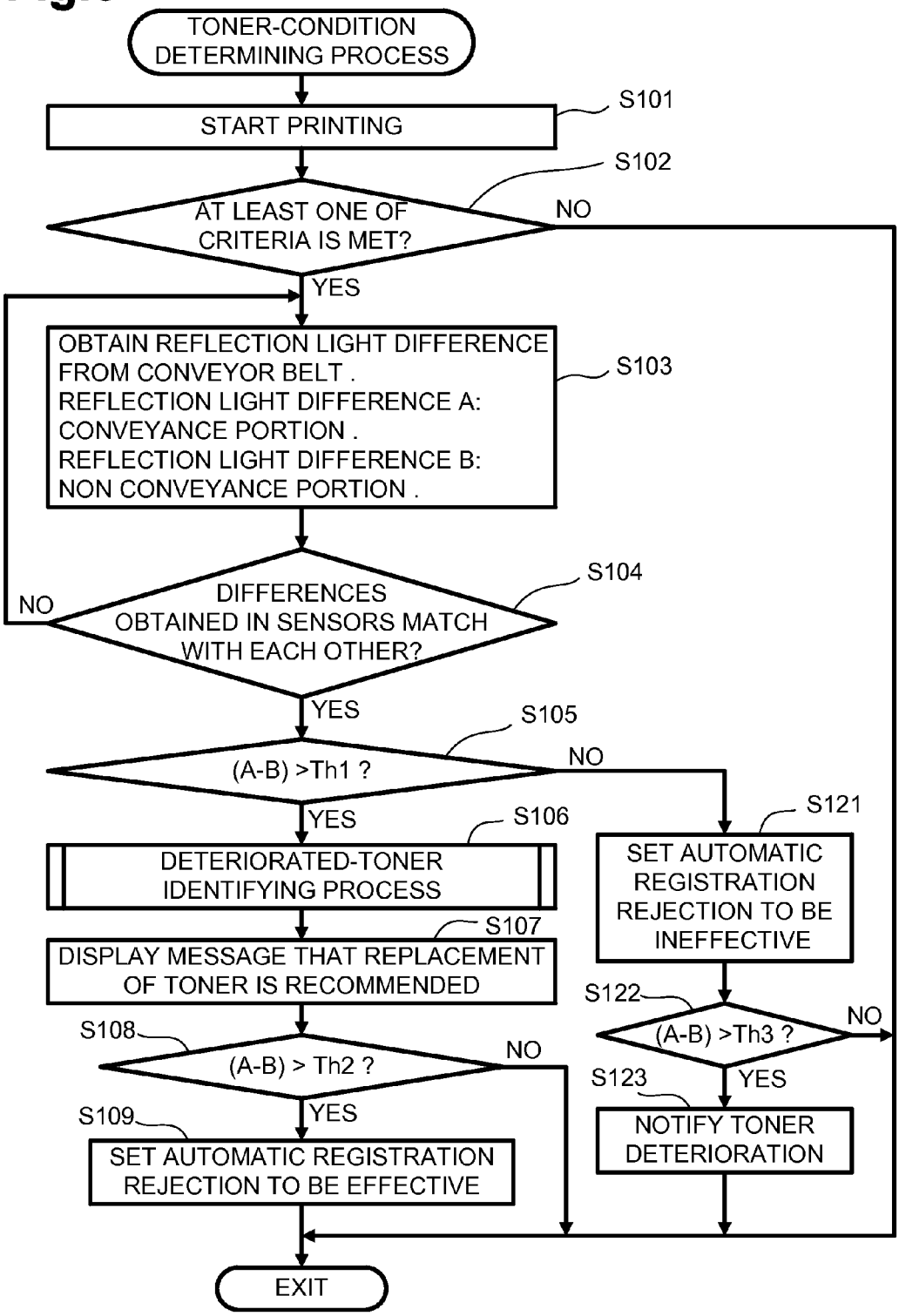
FIG. 6 is a flowchart depicting a toner-condition determining process performed in the multifunction peripheral device in the embodiment according to one or more aspects of the invention.

In step S107 of the toner-condition determining process of FIG. 6, based on the result of the deteriorated-toner identifying process of step S106, controller 30 may display a message indicating that replacement of toner is recommended, including information indicating the process unit that accommodates the deteriorated toner, on a display portion of operating panel 40 (step S107). In a case where MFP 100 has received a print job from another device, e.g., a personal computer, MFP 100 may send a message to the another device.

Next, controller 30 may determine whether the difference between reflection amount differences A and B (A–B) is greater than a second threshold value Th2 (step S 108). Second threshold value Th2 may be greater than threshold value Th1 referred in step S105.

When the difference between reflection amount differences A and B (A–B) is greater than second threshold value Th2 (step S108:YES), controller 30 may determine that an extremely larger amount of toner is present on conveyor belt 7. If registration pattern 66, which is a pattern image for positional deviation correction, is formed under this condition, sensor 61 may not detect marks 66C, 66M, 66Y, 66K constituting registration pattern 66 accurately. Thus, controller 30 may set a setting to reject automatic registration, in which registration pattern 66 is automatically formed (a registration pattern forming process), to be effective (step S109). After step S109 or when the difference between reflection amount differences A and B (A–B) is smaller than or equal to second threshold value Th2 (step S108:NO), controller 30 may exit the toner-condition determining process.

MFP 100 may automatically perform the registration pattern forming process when controller 30 determines that predetermined criteria for performance of the forming process are met. In the registration pattern forming process, when the automatic registration rejection setting is effective, controller 30 may determine that severe toner deterioration has occurred and may display a warning message indicating that replacement of toner is recommended on the display portion of operating panel 40. Then, controller 30 may cancel the registration pattern forming process, which may prevent unnecessary consumption of toner. The predetermined criteria for performance may be, for example, the time elapsed from the previous registration pattern forming process or the number of sheets S printed from the previous registration pattern forming process.

In step S105, when the difference between reflection amount differences A and B (A–B) is smaller than or equal to first threshold value Th1 (step 105:NO), controller 30 may set the automatic registration rejection setting to be ineffective (step S121). That is, controller 30 may set the automatic registration rejection setting, which had been set to be effective in step S109, to be ineffective. Accordingly, when the predetermined performance criteria are met, MFP 100 may form registration pattern 66 and obtain the amount of positional deviation.

Then, controller 30 may determine whether the difference between reflection amount differences A and B (A–B) is greater than a third threshold value Th3 (step S122). Third threshold value Th3 may be smaller than threshold value Th1 referred to in step S105.

When the difference between reflection amount differences A and B (A B) is greater than third threshold value Th3 (step S122:YES), controller 30 may display a warring message indicating that toner will become deteriorated in near future, on the display portion of operating panel 40 (step S123). At that time, based on the difference between reflection amount differences A and B (A–B), controller 30 may also display information that toner will become deteriorated after N pages of sheets S are printed or after MFP 11 is used for M hours, for example, together with the warring message. After step S123 or when the difference between reflection amount differences A and B (A–B) is greater than third threshold value Th3 (step S22:NO), controller 30 may exit the toner-condition determining process.

Figure 8:
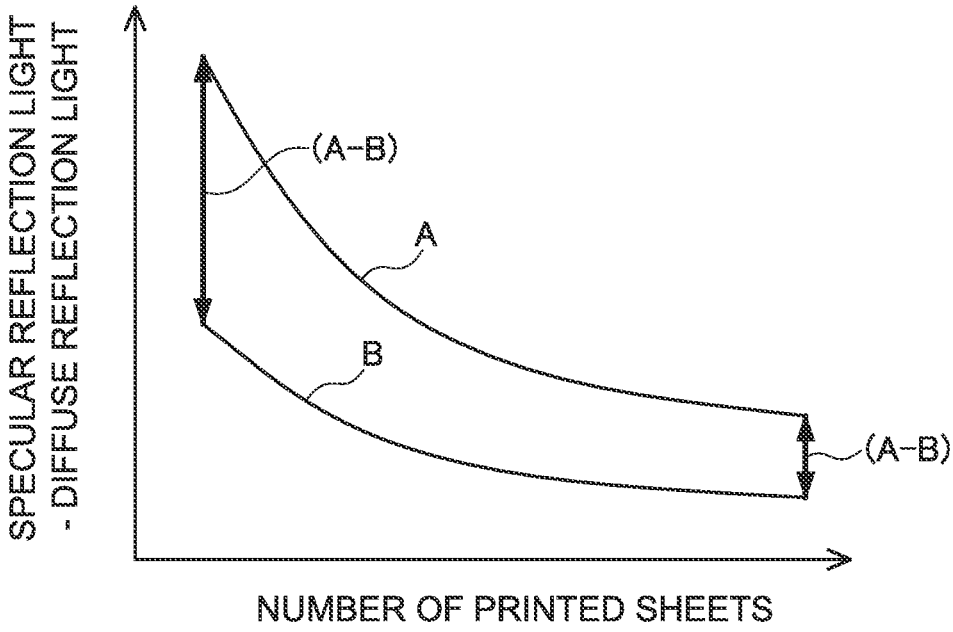
FIG. 8 is a graph representing a relationship between a difference between an amount of specular reflection light from the conveyor belt and an amount of diffuse reflection light from the conveyor belt and a number of printed sheets in the embodiment according to one or more aspects of the invention.

In the above-described embodiment, controller 30 may use the difference between reflection amount differences A and B (A–B) in the toner condition determination in steps S105, S108, S122, and S154. Alternatively, in other embodiments, controller 30 may use a ratio between reflection amount differences A and B in the toner condition determination. Each of light-emitting elements 62 of sensor 61 may emit a constant amount of light. Reflection light difference A in the conveyance portion and reflection light difference B in the nonconveyance portion may decrease as the number of printed sheets S increases as depicted in FIG. 8. This may be caused because a plurality of portions of the surface of conveyor belt 7 may be damaged by reason of use (e.g., friction from any source including paper, rollers, another belt, cleaning belts/rollers/blades, and the like) and thus the intensity of a specular reflection component may become weak although the surface of conveyor belt 7 may not be damaged and the intensity of the specular reflection component may be strong when conveyor belt 7 is in a brand new condition. The difference between reflection amount differences A and B (A–B) in the conveyance portion and the nonconveyance portion may tend to become smaller as the number of printed sheets S may increase. Accordingly, when the toner condition is determined based on the difference between reflection amount differences A and B (A–B), it may be desired that threshold values Th1, Th2, Th3, Th4 are changed based on the damage level of conveyor belt 7.

Changes of each of reflection amount differences A and B in accordance with the increase of the number of printed sheets S may not be significantly different from each other. Therefore, the toner condition determination may be performed based on the ratio between reflection amount differences A and B and threshold values with respect to the ratio may be stored for the toner condition determination. By doing so, it may be unnecessary to change the threshold values if conveyor belt 7 is damaged due to age deterioration. For example, when the ratio of the difference between reflection amount differences A and B (B/A) is obtained by dividing reflection amount difference B by reflection amount difference A, controller 30 may determine whether the ratio of the difference between reflection amount differences A and B (B/A) is smaller than a threshold value Th1' in step S105. As the toner deterioration condition becomes more severe, reflection amount difference B may become smaller. Therefore, the ratio of the difference between reflection amount differences A and B (B/A) may become smaller when the toner deterioration condition becomes more severe. When the ratio of the difference between reflection amount differences A and B (A/B) is obtained by dividing reflection amount difference A by reflection amount difference A, controller 30 may determine whether the ratio of the difference between reflection amount differences A and B (A/B) is greater than a threshold value Th1'. As the toner deterioration condition becomes more severe, the ratio of the difference between reflection amount differences A and B (A/B) may become greater.

When controller 30 determines the toner condition based on the difference between reflection amount differences A and B (A−B) as described in step S105, a weighting factor may assigned to a threshold value based on a damage level of conveyor belt 7. For example, ROM 32 may prestore that a reflection amount difference at the shipment is A0 and the first threshold value at the shipment is Th01. In a case where the reflection amount difference in the conveyance portion at one point of time is AX, first threshold value Th1 may be obtained using Expression 1 below.

$$Th1=(AX/A0)\times Th01 \qquad \text{Expression 1:}$$

In the above-described embodiment, in order to identify the process unit that accommodates deteriorated toner, controller 30 may repeatedly perform the toner condition determination on each process units 50C, 50M, 50Y, 50K. Nevertheless, in other embodiments, for example, controller 30 may not identify the process unit that accommodates deteriorated toner, and urge the user to replace toner of all of the colors.

Figure 9:
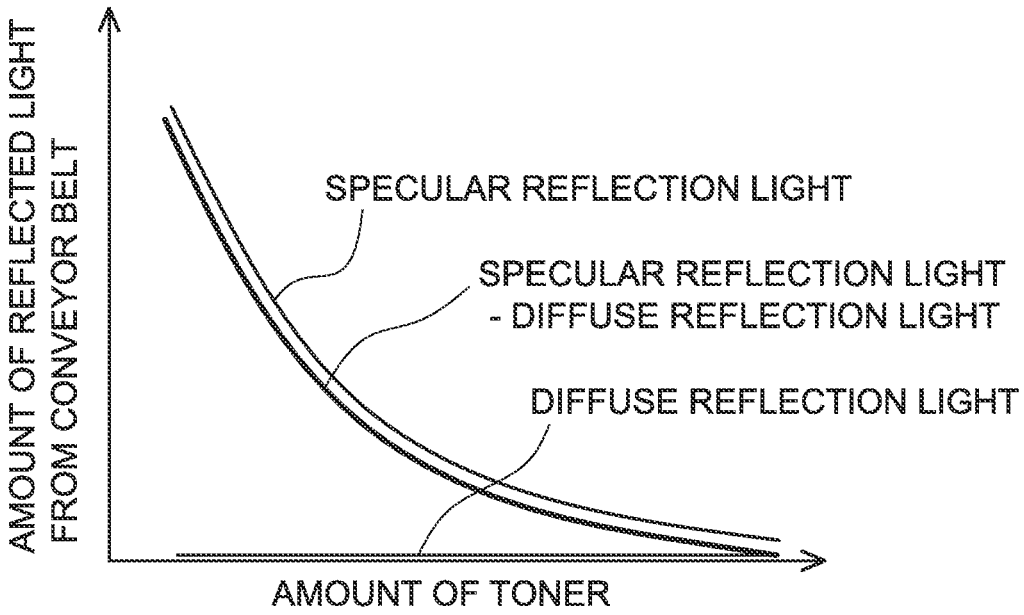
FIG. 9 is a graph representing a relationship between an amount of reflected light from the conveyor belt and an amount of toner (black) on the conveyor belt in the embodiment according to one or more aspects of the invention.

When toner of black K is in the deteriorated condition, controller 30 may identify the process unit 50K without performing the toner condition determination by each color. That is, as depicted in FIG. 9, as the amount of toner on conveyor belt 7 increases, only the amount of specular reflection light from conveyor belt 7 may significantly decrease although the amount of diffuse reflection light from conveyor belt 7 may hardly change. Accordingly, when the difference between reflection amount differences A and B (A−B) significantly changes in spite of fact that the amount of diffuse reflection light from conveyor belt 7 hardly changes, controller 30 may determine that a larger amount of toner of black K is present on conveyor belt 7, i.e., toner of black K is in the deteriorated condition.

In other embodiments, for example, process units 50C, 50M, 50Y, 50K may transfer images in different areas of conveyor belt 7. In this case, controller 30 may identify the process unit in which toner is in the deteriorated condition without performing the toner condition determination by each process unit like the above-described embodiment. For example, when the application of the developing bias and the transfer bias is turned on and then is turned off at the same time in all of process units 50C, 50M, 50Y, 50K, areas, which passed under the respective process units 50C, 50M, 50Y, 50K while the application of the developing bias and the transfer bias is on and may be referred to as bias-on areas (an example of the first area), may exist at different positions on conveyor belt 7. Therefore, controller 30 may identify the process unit in which toner is in the deteriorated condition, by identifying the position at which the reflection amount difference is caused. The application of the developing bias and the transfer bias may not necessarily be turned on and off at the same time, but it may be required that the bias-on areas on conveyor belt 7 are located at different positions by each process unit.

Figure 10:
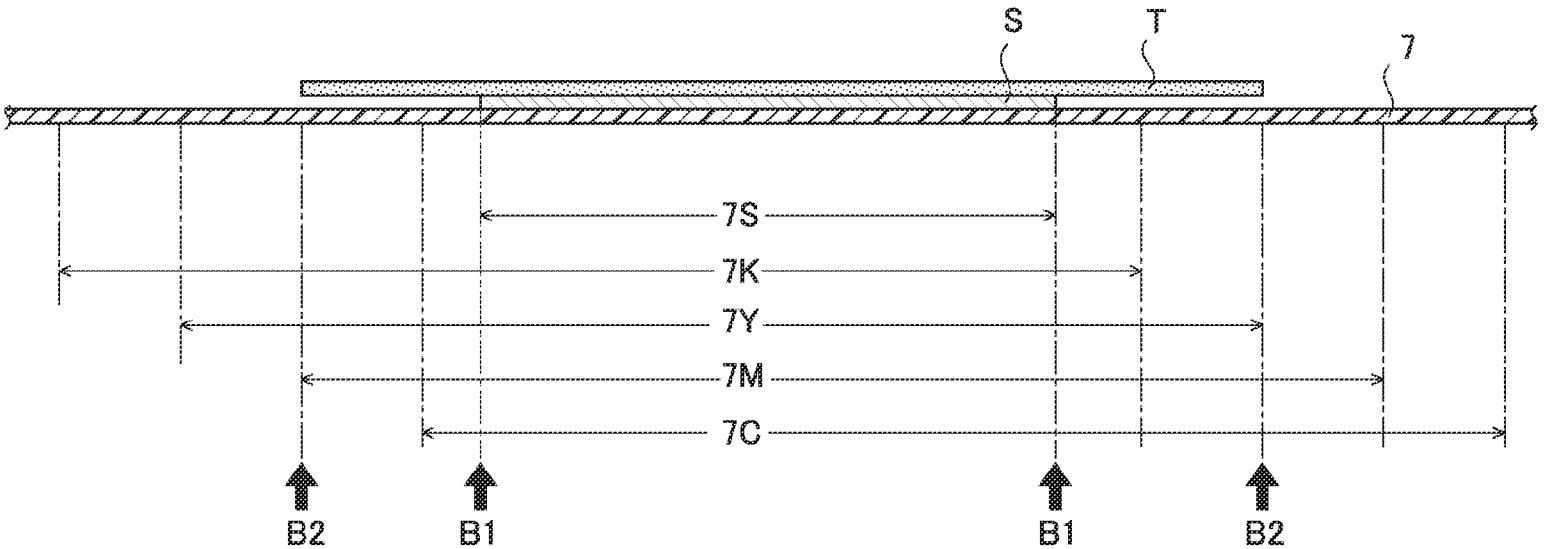
FIG. 10 depicts a positional relationship among toner of four colors when a printing operation is performed in four colors at the same time in the embodiment according to one or more aspects of the invention.

A positional relationship between the bias-on area of each of process unit 50C, 50M, 50Y, 50K and a sheet S is described in detail with reference to FIG. 10. There may be a bias-on area 7C biased by process unit 50C, a bias-on area 7M biased by process unit 50M, a bias-on area 7Y biased by process unit 50Y, a bias-on area 7K biased by process unit 50K, and a sheet conveyance portion 7S, on conveyor belt 7. The bias-on areas 7C, 7M, 7Y, 7K may be shifted from each other by the same distance as a pitch of between each adjacent process unit 50C, 50M, 50Y, 50K.

If toner becomes in the deteriorated condition in process unit 50M, transfer unit 5 may transfer deteriorated toner T onto bias-on area 7M of conveyor belt 7 from photosensitive member 1. At that time, transfer unit 5 may transfer deteriorated toner T onto a sheet S held on sheet conveyance portion 7S within bias-on area 7M of conveyor belt 7 and MFP 100 may then discharge the sheet S having deteriorated toner T to the outside thereof. Transfer unit 5 may transfer deteriorated toner T onto the surface of conveyor belt 7 from photosensitive member 1 at the portion where the sheet S is absent within bias-on area 7M. Therefore, sensor 61 may detect a larger amount of toner at the portion other than the sheet conveyance portion 7S within bias-on area 7M by process unit 50M, i.e., the amount of reflected light from bias-on area 7M of conveyor belt 7 may decrease.

Thus, differences in toner amount on conveyor belt 7 may occur between sheet conveyance portion 7S and the nonconveyance portion within bias-on area 7M and between bias-on area 7M and a bias-off area, which is an area other than the bias-on area 7M. Sheet conveyance portion 7S may border on the nonconveyance portion within bias-on area 7M and their border may be indicated by an arrow B1 in FIG. 10. Bias-on area 7M may border on the bias-off area along the sheet conveying direction and their border may be indicated by an arrow B2 in FIG. 10. Controller 30 may detect that the amount of toner on conveyor belt 7 significantly changed at the position other than the border between sheet conveyance portion 7S and the nonconveyance portion and identify the position (indicated by arrow B2 in FIG. 10). Thus, controller 30 may identify that toner is in the deteriorated condition in process unit 50M.

Controller 30 may identify each end of bias-on areas 7C, 7M, 7Y, 7K of process units 50C, 50M, 50Y, 50K based on the time at which the application of the developing bias and the transfer bias was turned on and the rotating speed of conveyor belt 7. Therefore, it may be unnecessary to detect an entire area of bias-on area 7C, 7M, 7Y, 7K to detect the difference in the amount of toner between bias-on area 7C, 7M, 7Y, 7K and the bias-off area. That is, sensor 61 may detect an amount of toner in a part of bias-on area 7C, 7M, 7Y, 7K and an amount of toner in a part of the bias-off area, in which the bias-on area and the bias-off area border each other along the sheet conveying direction and the part of bias-area 7C, 7M, 7Y, 7K and the part of the bias-off area are neighboring each other along the sheet conveying direction.

As described above, in MFP 100 according to the embodiment, controller 30 may determine that a large amount of deteriorated toner exists on conveyor belt 7 and the toner is in the deteriorated condition when the difference in the amount of toner estimated based on the reflection amount difference is large between the conveyance portion (an example of the first area), on which toner may not be transferred onto conveyor belt 7, and the nonconveyance portion, on which toner may transferred onto conveyor belt 7. In the toner condition determination, controller 30 may be required to obtain the amount of toner in the conveyance portion and the amount of toner in the nonconveyance portion of conveyor belt 7, but may not be required to obtain the amount of toner in the entire area of conveyor belt 7. Thus, the toner condition determination may be hardly influenced by the damage on the surface of conveyor belt 7. If controller 30 determines the toner condition based on one portion of conveyor belt 7, it may be difficult to determine that the decrease of the reflection amount difference is caused by the deterioration of toner or by specular changes in conveyor belt 7. Therefore, as the embodiment described above, controller 30 may determine the toner condition based on the comparison of the reflection amount differences between at least two portions, e.g., an area on which toner may be transferred, and an area on which toner may not be transferred. By doing so, the difference between the reflection amount difference in the area influenced by the deteriorated toner and the reflection amount difference in the area not influenced by the deteriorated toner may become clear. Accordingly, the toner condition determination may be performed with higher accuracy in MFP 100.

While various aspects of the invention has been described in detail with reference to the specific embodiments thereof, it would be apparent to those skilled in the art that various changes, arrangements and modifications may be applied therein without departing from the spirit and scope of the invention. For example, the image forming apparatus may not be limited to the multifunction peripheral device but may be applied to may devices having a printing function, e.g., printers, copying machines, facsimile machines.

In the above-described embodiment, MFP 100 may convey a sheet S by conveyor belt 7 and transfer an image directly onto the sheet S. However, the invention may not be limited to the specific embodiment. In other embodiments, for example, an MFP may comprise an intermediate transfer belt (e.g., belt 7 of FIGS. 3 and 4 being an intermediate transfer belt) and transfer an image onto a sheet S via the intermediate transfer belt.

In the above-described embodiment, registration pattern 66 may be formed on the both end portions of conveyor belt 7 in the belt-width direction. Nevertheless, in other embodiments, for example, registration pattern 66 may be formed on either of the end portions of conveyor belt 7 in the belt-width direction. In this case, sensor 61 may comprise a single sensor that may be disposed on the side at which registration pattern 66 may be formed.

In the above-described embodiment, the four process units 50C, 50M, 50Y, 50K may form the marks for image adjustment. However, the number of process units to be provided may not be limited to the specific embodiment. In other embodiments, for example a single process unit may form marks for image adjustment.

In the above-described embodiment, sensor 61 may measure both of the marks and the amount of toner present on conveyor belt 7 for determining the mark removal condition. However, a different sensor may be used for the individual measurements.

In the above-described embodiment, the deteriorated-toner identifying process may be a part of the toner-condition determining process. Nevertheless, in other embodiments, for example, the deteriorated-toner identifying process may be performed as a separate process. For example, controller 30 may provide a warning of toner deterioration in the toner-condition determining process, and may perform the deteriorated-toner identifying process at an arbitrary timing in accordance with the user's operation. It may be unnecessary to stop the printing currently performed if the deteriorated-toner identifying process is not performed in the toner-condition determining process.

In the above-described embodiment, controller 30 may estimate the amount of toner on conveyor belt 7 based on the reflection amount differences. However, the invention may not be limited to the specific embodiment. For example, controller 30 may estimate the amount of toner on conveyor belt 7 based on the amount of specular light reflection only or based on the amount of diffuse light reflection only. In a case where the estimation is performed based on the amount of specular light reflection only, the amount of specular light reflection may decrease as the amount of toner increases. Therefore, controller 30 may determine that the toner is in the deteriorated condition when the amount of specular light reflection is smaller than a specified value. In a case where the estimation is performed based on the amount of diffuse light reflection only, the amount of diffuse light reflection may increase as the amount of toner also increases. Therefore, controller 30 may determine that the toner is in the deteriorated condition when the amount of diffuse light reflection is larger than a specified value. The specified values may be determined appropriately for both cases. That is, the threshold values and inequality signs to be used in the toner-condition determining process and the deteriorated-toner identifying process may be set appropriately for each case.

The amount of specular reflection light from toner of black K on conveyor belt 7 may significantly change in accordance with the amount of toner. Therefore, the amount of specular reflection light may be used for the toner condition determination for the toner of black K. The amount of diffuse reflection light from toner of other colors, e.g., cyan C, magenta M, and yellow Y, may also significantly change in accordance with the amount of toner. Therefore, the amount of diffuse reflection light may be used for the toner condition determination with respect to the toner of cyan C, magenta M, and yellow Y. As described above, appropriate one of the amount of specular reflection light and the amount of diffuse reflection light may be selectively used by color of toner.

In the above-described embodiment, single CPU 31 may perform all of the processes. Nevertheless, the invention may not be limited to the specific embodiment thereof, and a plurality of CPUs, a special application specific integrated circuit ("ASIC"), or a combination of a CPU and an ASIC may be used to perform the processes.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus comprising:

a photosensitive member;

a developing device configured to store toner and form a toner image with the toner on the photosensitive member;

a conveying member configured to convey the toner transferred from the photosensitive member, and including a first area, on which the toner is transferred, and a second area, on which the toner is not transferred;

a detector configured to detect one or more properties of toner on the conveying member; and a control device configured to measure an amount of toner present on the conveying member based on the detected one or more properties and to determine whether the toner is in a deteriorated condition based on a difference in the amount of toner between the first area and the second area.

2. The image forming apparatus according to claim 1, wherein the conveying member includes a sheet conveyor belt configured to convey a sheet, wherein the first area includes an area under the conveyed sheet; and wherein the second area includes an area not under the conveyed sheet.

3. The image forming apparatus according to claim 1, wherein the first area includes an area to which a developing bias and a transfer bias are applied; and wherein the second area includes an area to which at least one of the developing bias and the transfer bias is not applied.

4. The image forming apparatus according to claim 1, wherein the image forming apparatus includes a plurality of photosensitive members and a plurality of developing devices, wherein the conveying member includes a plurality of first areas that are defined at different locations by each of the plurality of photosensitive members; and wherein the control device is configured to:

specify a position at which the difference in the amount of toner is caused between the first area and the second area of the conveying member; and identify the developing device that stores toner which is deteriorated, based on the specified position.

5. The image forming apparatus according to claim 1, wherein the image forming apparatus includes a plurality of photosensitive members and a plurality of developing devices;

wherein at least one of the plurality of developing devices forms a toner image with black toner on a corresponding one of the plurality of photosensitive members;

wherein the detector is configured to detect light reflected from the toner;

wherein the control device is configured to measure the amount of toner by analyzing the detected reflected light; and wherein the control device is configured to determine whether the black toner is in the deteriorated condition based on a component of the reflected light received by the detector.

6. The image forming apparatus according to claim 1, wherein the control device is configured to determine that the toner is in the deteriorated condition when the difference in the amount of toner between the first area and the second area is greater than or equal to a reference value.

7. The image forming apparatus according to claim 1, wherein the control device is configured to determine whether the toner is in the deteriorated condition based on a ratio of the amount of toner between the first area and the second area.

8. The image forming apparatus according to claim 1, wherein the detector is configured to detect reflected light from at least two measurement positions arranged along a width direction of the conveying member;

wherein the control device is configured to measure the amount of toner at at least two measurement positions arranged along a width direction of the conveying member based on the detected reflected light at each of the measurement positions; and wherein the control device is configured to determine that the toner is in the deteriorated condition based on the measurement result.

9. The image forming apparatus according to claim 1, wherein the photosensitive member is a photosensitive drum.

10. The image forming apparatus according to claim 1, wherein the photosensitive member is a photosensitive belt.

11. The image forming apparatus according to claim 1, wherein the conveying member is an intermediate transfer belt.

12. An image forming apparatus comprising:

a photosensitive member;

a developing device configured to store toner and form a toner image with the toner on the photosensitive member;

a conveying member configured to convey the toner transferred from the photosensitive member, and including a first area, on which the toner is transferred, and a second area, on which the toner is not transferred;

a detector configured to detect one or more properties of the toner on the conveying member; and means for measuring an amount of toner present on the conveying member based on the detected one or more properties and determining whether the toner is in a deteriorated condition based on a difference in the amount of toner between the first area and the second area.

13. The image forming apparatus according to claim 12, wherein the image forming apparatus includes a plurality of photosensitive members and a plurality of developing devices, wherein the conveying member includes a plurality of first areas that are defined at different locations by each of the plurality of photosensitive members; and wherein the means for measuring and determining further specifies a position at which the difference in the amount of toner is caused between the first area and the second area of the conveying member, and identifies the developing device that stores toner which is deteriorated, based on the specified position.

14. The image forming apparatus according to claim 12, wherein the image forming apparatus includes a plurality of photosensitive members and a plurality of developing devices;

wherein at least one of the plurality of developing device forms a toner image with black toner on a corresponding one of the plurality of photosensitive members;

wherein the detector is configured to detect light reflected from the toner;

wherein the means for measuring and determining is configured to measure the amount of toner by analyzing the detected reflected light; and wherein the means for measuring and determining is configured to determine whether the black toner is in the deteriorated condition based on a component of the reflected light received by the detector.

15. The image forming apparatus according to claim 12, wherein the means for measuring and determining is configured to determine that the toner is in the deteriorated condition when the difference in the amount of toner between the first area and the second area is greater than or equal to a reference value.

16. The image forming apparatus according to claim 12, wherein the means for measuring and determining is configured to determine whether the toner is in the deteriorated condition based on a ratio of the amount of toner between the first area and the second area.

17. The image forming apparatus according to claim 12, wherein the detector is configured to detect reflected light from at least two measurement positions arranged along a width direction of the conveying member;

wherein the means for measuring and determining is configured to measure the amount of toner at at least two measurement positions arranged along a width direction of the conveying member based on the detected reflected light at each of the measurement positions; and wherein the means for measuring and determining is configured to determine that the toner is in the deteriorated condition based on the measurement result.

18. A method for determining a condition of toner comprising:

depositing toner onto a first area of a conveying member;

detecting one or more properties of the toner on the first area of the conveying member and on a second area of the conveying member;

measuring an amount of toner present on the conveying member based on the detected one or more properties; and determining whether the toner is in a deteriorated condition based on a difference in the amount of toner between the first area and the second area.

19. The method according to claim 18, wherein the determining step determines that the toner is in the deteriorated condition when the difference in the amount of toner between the first area and the second area is greater than or equal to a reference value.

20. The method according to claim 18, wherein the determining step determines whether the toner is in the deteriorated condition based on a ratio of the amount of toner between the first area and the second area.

* * * * *